United States Patent [19]

Harrington

[11] Patent Number: 4,555,818

[45] Date of Patent: Dec. 3, 1985

[54] WASTE LINE TRAP

[76] Inventor: Robert E. Harrington, 5708 Ranger St., Virginia Beach, Va. 23464

[21] Appl. No.: 666,392

[22] Filed: Oct. 30, 1984

[51] Int. Cl.[4] ..... E03C 1/26

[52] U.S. Cl. ..... 4/191; 4/257

[58] Field of Search ..... 4/191, 255, 257, 290–292, 4/DIG. 14; 210/460, 461, 463

[56] References Cited

U.S. PATENT DOCUMENTS

| | | | |
|---|---|---|---|
| 1,811,728 | 6/1931 | McKee | 210/463 |
| 2,506,669 | 5/1950 | Heuacker | 4/292 |
| 2,744,738 | 5/1956 | Hjulian | 210/460 |
| 2,885,689 | 5/1959 | Morris | 4/191 |
| 3,021,528 | 2/1962 | Hargrave | 4/257 |
| 3,268,920 | 8/1966 | Beer | 4/292 |
| 4,307,476 | 12/1981 | Halstad | 4/255 |
| 4,318,547 | 3/1982 | Ericson | 277/207 A |

FOREIGN PATENT DOCUMENTS

| | | | |
|---|---|---|---|
| 21703 | of 1896 | United Kingdom | 4/257 |

*Primary Examiner*—Stephen Marcus
*Assistant Examiner*—Leo J. Peters
*Attorney, Agent, or Firm*—Sughrue, Mion, Zinn, Macpeak & Seas

[57] ABSTRACT

A waste line trap is provided to prevent foreign objects and debris from being flushed through commodes into waste line systems. The waste line trap has a solid cylinder with continuous outer and inner walls. A plurality of angled fins are spaced equidistantly on the inner wall and extend outwardly toward the center of the cylinder. The fins have downwardly extending top beveled edges which terminate in vertically extending inner beveled side edges. The trap is installed in the discharge line of a commode and functions to catch foreign objects and debris from entering the main sewerage line.

9 Claims, 4 Drawing Figures

WASTE LINE TRAP

BACKGROUND OF THE INVENTION

1. Field of the Invention

This invention pertains to waste traps for sewer lines to prevent foreign objects from passing into sewer line systems thereby clogging same.

2. Description of the Prior Art

The prior art disclose devices which are positioned in sinks or toilet bowls and function to catch debris and prevent same from entering the main discharge line. Representative of the prior art are the following patents.

| Patentee | U.S. Pat. No. | Issue Date |
|---|---|---|
| H. M. Lehmann | 2,693,603 | Nov. 9, 1954 |
| H. Hoffman et al | 2,785,561 | March 19, 1957 |
| D. C. Beer | 3,268,920 | Aug. 30, 1966 |
| Walraven | 4,301,557 | Nov. 24, 1981 |
| Halstad | 4,307,476 | Dec. 29, 1981 |

Lehmann (U.S. Pat. No. 2,693,603) is a device comprising an expandable ring and hook arrangement. The device is placed in the outlet channel of a toilet bowl and the hook functions to snag washcloths and the like which are inadvertently dropped into the toilet bowl. The disadvantage of the Lehmann device is that it also snags paper products which are normally disposed of in toilet bowls. A further disadvantage of Iahmann is that it will not snag or catch solid objects such as containers. In addition, the hook portion will rust in a short period of time and the device must be removed and a new one replaced.

Hoffman et al (U.S. Pat. No. 2,785,561) is a screen for use in toilet bowls and it functions to support soiled articles such as diapers which are rinsed by flushing. Beer (U.S. Pat. No. 3,268,920) is a waste trap device which is used in bath and basin waste lines thus preventing same from becoming clogged. The device is comprised of a series of arks having a plurality of inwardly extending triangular portions having upstanding spikes and barbs. The disadvantage of this device is that it is too fragile to be maintained in a main sewer line.

Walraven (U.S. Pat. No. 4,301,557) is a strainer device which is used in sinks and functions to minimize clogging. This device could not be used in a main sewer line as it would prevent the passage of normal paper products.

Halstad (U.S. Pat. No. 4,307,476) is similar to Lehmann in that it comprises a ring having a number of inwardly extending spikes. Further, this device is permanently in place in the outlet channel of a household toilet bowl. The device has the same shortcomings as Lehmann in that the hooks function to snag articles of clothing and heavy paper and will not function to prevent the passage of solid objects such as containers. Moreover, this device is also subject to corrosion after a short period of time which will require its replacement.

SUMMARY OF THE INVENTION

The waste trap of this invention is a solid and sturdy device which is easy to manufacture and install in sewer lines.

An object of this invention is to produce an efficient waste trap which will allow the passage of normal waste material yet function to prevent the passage of foreign objects such as rags, cloths, sanitary napkins and solid objects such as cans or containers.

Another object of this invention is to produce a solid sturdy device which will withstand the corrosive effects of water.

Yet another object of this invention is to produce a device having a solid heavy duty cylinder and a plurality of solid heavy duty fins extending inwardly of the cylinder and which function to prevent the passage of foreign objects into a sewer line system.

These and other objects of this invention will become apparent to those skilled in the art from a view of the attached drawings and the following specification.

DESCRIPTION OF THE PREFERRED EMBODIMENT OF THE INVENTION

Figure 3:
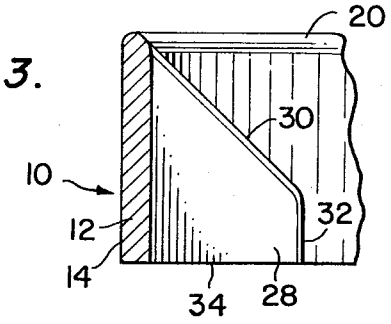
FIG. 3 is a sectional view of the waste trap taken along the line 3—3 of FIG. 2 and it shows a section of a solid cylinder and an inwardly extending fin having a downwardly slanting edge which terminates in a vertical edge.
Figure 1:
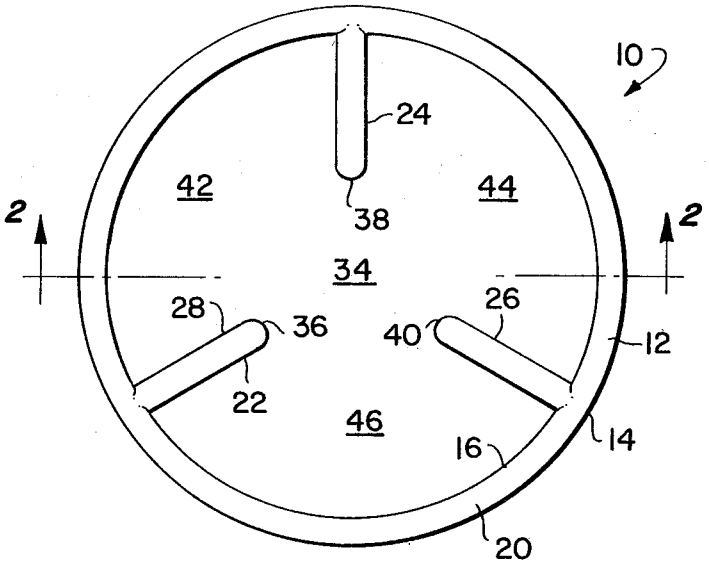
FIG. 1 is a plan view of the waste trap showing a solid cylinder and inwardly extending fins.
Figure 2:
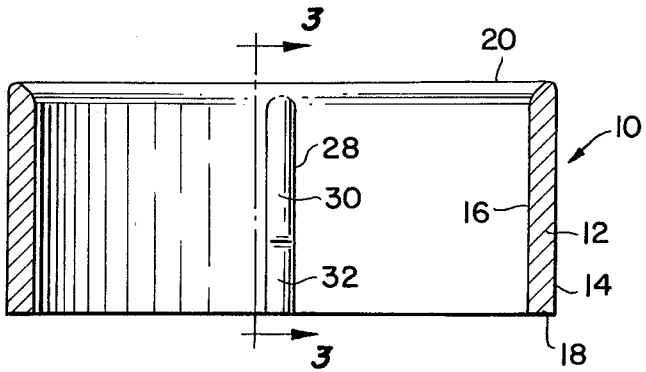
FIG. 2 is a cutaway view of the waste trap taken along the line 2—2 of FIG. 1 and shows a section of a solid cylinder and an inwardly extending fin.

Referring now in more detail to the drawings, FIGS. 1–3 show a waste trap 10 having a solid cylinder 12 which is cast or molded metal or synthetic material. The solid cylinder 12 has a continuous outer wall 14, a continuous inner wall 16, a flat bottom edge 18 and a top beveled edge 20. The height of the cylinder 12 is $1\frac{1}{2}$ inches with a wall thickness of 3/16th inches. The continuous inner wall 16 is interupted by a plurality of integral fins 22, 24 and 26. The fins are spaced 120° around the inner wall and extend inwardly a distance of 1 inch from the inner wall of the cylinder. Each of the fins 22, 24 and 26 has outer faces 28, downwardly slanting beveled top sides 30 which terminate in vertical rounded inner sides 32 and horizontal bottom sides 34. the side of each end adjacent the inner wall 16 is equal in height thereto and the inner sides 32 are substantially less in height than the height of the inside wall 16 of the cylinder 12. Each fin extends inwardly 1 inch from the inner continuous wall and the area between points 36, 38 and 40 define an opening of $1\frac{1}{4}$ inches. The downward angle of each fin is 45° and the top rounded or beveled sides permit easy passage of normal waste material.

The spaces 42, 44 and 46 between the fins permit the passage of disintegratable solids as well as liquids. Yet, the spaces are not large enough to permit the passage of foreign objects such as cloth articles, paper articles such as bags and cups and other solid objects such as cans, wallets, books, magazines, scourging pads and like foreign objects.

Figure 4:
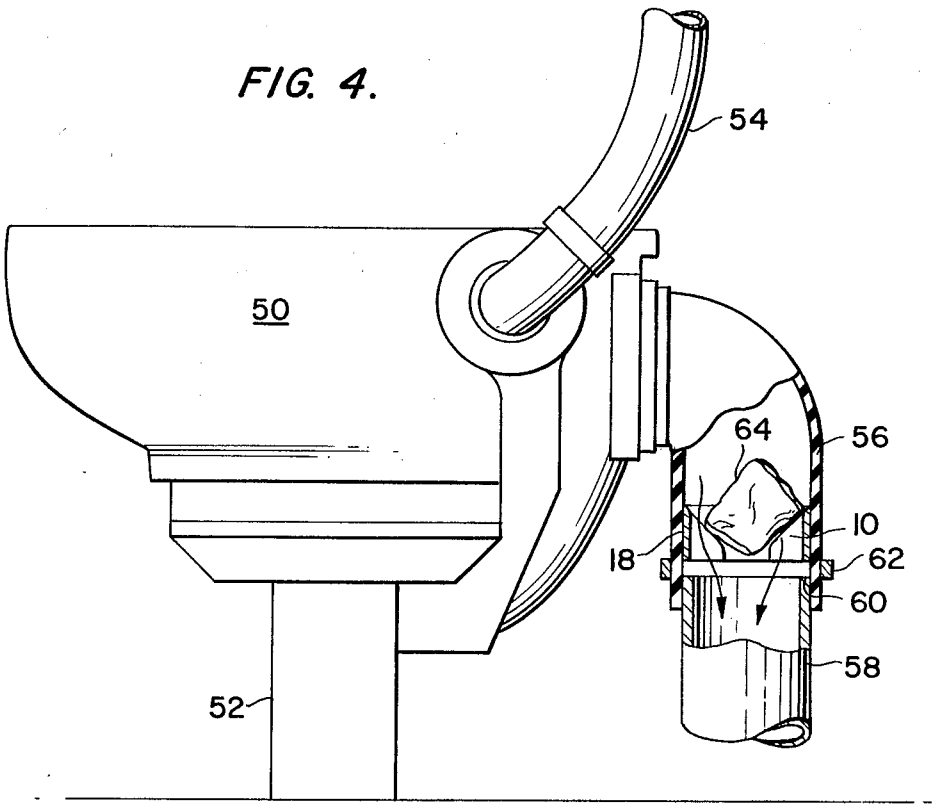
FIG. 4 is a perspective view of a toilet system showing the waste trap in position in the sewer line.

FIG. 4 is a perspective view of a toilet system having a toilet bowl 50, a support pedestal 52, a flush line 54 and a waste discharge line 56 into which a second discharge line 58 is telescoped. The waste trap 10 has an outter diameter approximately equal to the inner diameter of line 56 but larger in outer diameter than the inner diameter of line 58. The waste trap 10 is positioned within the line 56 with the bottom edge 18 resting on the top edge 60 of the line 58. The lines 56 and 58 are secured together by a hose clamp 62.

As will be appreciated, a solid or large foreign object 64 is trapped by the fins 22, 24 and 26 and thus prevented from entering the main sewerage line 58. After a period of time, the line 56 will become clogged by foreign objects which are easily removed by removing the hose clamp 62 which will permit raising of line 56 whereby the trap and debris may be removed. The trap is then replaced in the system for additional use.

While the invention has been described with respect to a preferred embodiment thereof, it will be appreciated by those skilled in the art to which this invention pertains that additional modifications may be made in the invention without departing from the spirit and scope thereof.

What I claim is:

1. A waste trap for a conduit comprising:

a solid cylinder having a continuous outer wall and a continuous inner wall, said cylinder being smaller in diameter than said conduit;

a plurality of equidistantly spaced inwardly extending fins on the inner wall, said fins having walls adjacent to the inner wall of the cylinder and equal in height thereto; and said fins having downwardly extending smooth edges terminating in vertical edges, said vertical edges being smooth and being substantially less in height than the height of the cylinder.

2. A waste trap for a conduit comprising:

a solid cylinder substantially greater in height than its width said solid cylinder being less in diameter than said conduit;

a plurality of solid fins integral with and extending inwardly of the cylinder 1 inch to center forming a central opening of $1\frac{1}{4}$ inches, said solid fins having walls adjacent to the inner wall of the cylinder and equal in height thereto; and said fins having downwardly extending top smooth beveled edges at 45° angle relative to the walls of the cylinder and terminating in vertical extending inside beveled smooth edges, said inside beveled edges substantially less in height than the height of the cylinder.

3. A waste trap for a conduit comprising:

a solid cylinder having a continuous outside wall, a continuous inside wall, a top beveled edge, a bottom flat edge and being smaller in diameter than said conduit;

said walls being substantially greater in height than the thickness thereof;

a plurality of integral inwardly extending fins having flat side walls, walls adjacent to said inside wall and equal in height thereto, downwardly extending top beveled smooth edges at 45° relative to said cylinder, and vertically extending inner beveled smooth edges substantially less in height than the height of the cylinder;

open spaces between said fins and between said vertically extending beveled smooth edges, and said fins defining a trap preventing passage of foreign objects.

4. A waste trap according to claim 1, wherein:

said solid cylinder being substantially greater in height than its thickness.

5. A waste trap according to claim 1, wherein:

said solid cylinder having top beveled edges and a flat bottom edge.

6. A waste trap according to claim 1, wherein:

said fins having flat faces, downwardly slanting top beveled edges and vertically extending inner beveled edges.

7. A waste trap according to claim 1, wherein:

said fins spaced 120 apart and extending inwardly 1 inch to center forming a central aperture of $1\frac{1}{4}$ inches.

8. A waste trap according to claim 1, wherein:

said waste trap positioned within a waste discharge line extending from a toilet.

9. A waste trap according to claim 8, wherein:

said waste trap positioned within a discharge conduit of a toilet of the type on board ocean going vessels.

* * * * *